US007544458B2

(12) United States Patent
Iraqi et al.

(10) Patent No.: US 7,544,458 B2
(45) Date of Patent: Jun. 9, 2009

(54) COMPOSITION, METHOD AND DEVICE FOR LIQUID ELECTROPHOTOGRAPHIC PRINTING

(75) Inventors: Muhammad Iraqi, Tira (IL); Albert Teishev, Rishon le-zion (IL); Gregory Katz, Holon (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 208 days.

(21) Appl. No.: 11/524,019

(22) Filed: Sep. 20, 2006

(65) Prior Publication Data

US 2007/0031751 A1 Feb. 8, 2007

Related U.S. Application Data

(63) Continuation of application No. PCT/US2005/026627, filed on Jul. 27, 2005.

(51) Int. Cl.
*G03G 9/00* (2006.01)

(52) U.S. Cl. ..... 430/115

(58) Field of Classification Search ..... 430/115
See application file for complete search history.

(56) References Cited

U.S. PATENT DOCUMENTS 5,212,526 A 5/1993 Domoto et al.
5,364,726 A 11/1994 Morrison et al.
5,482,809 A * 1/1996 Rao et al. ..... 430/114
5,547,804 A 8/1996 Nishizawa et al.
6,837,839 B2 1/2005 Payne et al.
2003/0086735 A1 5/2003 Payne et al.

FOREIGN PATENT DOCUMENTS

| | | | |
|---|---|---|---|
| DE | 19511476 | A1 | 11/1995 |
| EP | 1607799 | A | 12/2005 |
| JP | 61156262 | A | 7/1986 |
| JP | 62098364 | A | 5/1987 |
| JP | 06056946 | A | 3/1994 |
| WO | 9406059 | A | 3/1994 |
| WO | 2005109110 | A1 | 11/2005 |

OTHER PUBLICATIONS

International Search Report mailed May 2, 2007 for PCT/US2006/042404, filed Oct. 31, 2001, inventor Iraqi, et al.
International Search Report mailed Mar. 17, 2006 for PCT/US2005/026627, filed Jul. 27, 2005, inventor, Teishev, et al.

* cited by examiner

*Primary Examiner*—Mark A Chapman

(57) ABSTRACT

A UV-curable composition and liquid toner useful for electrophotographic printing, a method of electrophotographic printing and a device for electrophotographic printing are disclosed. A UV-curable composition and UV-curable liquid toner useful for electrophotographic printing includes a higher-acrylate, i.e. a triacrylate or higher. Such a composition and toner provide for scratch resistant print.

27 Claims, 2 Drawing Sheets

COMPOSITION, METHOD AND DEVICE FOR LIQUID ELECTROPHOTOGRAPHIC PRINTING

RELATED APPLICATIONS

This application is a continuation of, and claims priority to, copending Application No. PCT/US2005/026627 with a filing date of Jul. 27, 2005.

FIELD AND BACKGROUND OF THE INVENTION

The present invention relates to digital printing and especially to a method and device useful for liquid electrophotography. Specifically, the present invention is of a composition that allows electrophotographic printing with improved scratch resistance.

Digital printing involves technologies in which a printed image is created directly from digital data, for example using electronic layout and/or desktop publishing programs. Known methods of digital printing include full-color inkjet, electrophotographic printing, laser photo printing, and thermal transfer printing methods.

Electrophotographic printing techniques involve the formation of a latent image on a photoconductor surface mounted on an imaging plate. The photoconductor is first sensitized to light, usually by charging with a corona discharge, and then exposed to light projected through a positive film of the document to be reproduced, resulting in dissipation of the charge in the areas exposed to light. The latent image is subsequently developed into a full image by the attraction of oppositely charged toner particles to the charge remaining on the unexposed areas. The developed image is transferred from the photoconductor to a rubber offset blanket, from which it is transferred to a substrate, such as paper, plastic or other suitable material, by heat or pressure or a combination of both to produce the printed final image.

The latent image is developed using, either a dry toner (substantially toner particles mixed with a powder carrier) or a liquid toner (substantially a suspension of toner particles in a liquid carrier). The toner particles generally adhere to the substrate surface with little penetration into the substrate. The quality of the final image is largely related to the size of the toner particles, with higher resolution provided by smaller toner particles.

Dry toners used in solid electrophotography are fine powders with a relatively narrow particle size distribution that are expelled from fine apertures in a print head. A typical dry toner is predominantly composed of a heat-sensitive polymer (e.g., acrylic, styrene) and a pigment such as carbon black with a solid carrier, typically resin coated iron or steel powders. Variations in particle shape and charge-to-mass ratio as well as dust particles found in dry toner may cause technical difficulties during the printing process. Larger or irregularly shaped particles can cause blockage while dust particles that are too small to hold a sufficient charge to be controllable adhere to the print head surface.

Liquid toners used in liquid electrophotography are composed of pigmented or dyed thermoplastic resin particles suspended in a non-conducting liquid carrier, generally a saturated hydrocarbon. Offset-preventing and release-facilitating oil, such as silicone oil, is often used to increase the efficiency of toner transfer from the imaging surface. The liquid toner is electrophotographically charged and brought into contact with the photoconductor surface to develop the latent image. When transferred to an offset blanket and heated, the particles melt and fuse to form a tacky polymer film. When the tacky polymer film comes in contact with a cooler surface, such as a paper substrate, the film hardens and adheres to the substate, and peels away from the blanket, laminating the paper. The ink is deposited onto the substrate essentially dry, and desired print finishing can be performed immediately. Since the ink is transferred completely from the blanket to the substrate, a new layer in a different colour can be created for every rotation of the press.

Electroink®, commercially available from Hewlett Packard Company (Maastricht, The Netherlands), is a particularly effective liquid toner for electrophotography containing a dispersion of pigmented polymer particles ranging in size from 1-2 microns, in a hydrocarbon carrier, such as an aliphatic hydrocarbon. A preferred carrier used in the preparation of Electroink® is available under the tradename Isopar® from Exxon Mobil Corporation, Fairfax, Va., USA.

The small particle size used in liquid toners such as Electroink® allows the printing of high resolution, high gloss images, with sharp edges and very thin image layers. However, due to the fact that the print produced by liquid toner is not absorbed into the paper but is attached to the paper surface by adhesive traction, the print may be prone to damage by scratching, peeling or flaking.

International Patent Application No. PCT/US2005/026627 of the Applicant which is incorporated by reference as if fully set forth herein teaches a UV-curable composition that allows electrophotographic printing having improved wear resistance, especially peeling and flaking resistance. A specific composition taught in International Patent Application No. PCT/US2005/026627, including a mixture of monoacrylates and diacrylate provides a significant improvement to the art of printing. Despite the fact that the specific composition of International Patent Application No. PCT/US2005/026627 provides print having excellent peeling and flaking resistance, there is a desire for print having even better scratch resistance.

It would be highly advantageous to provide print produced by electrophotographic printing having improved scratch resistance.

SUMMARY OF THE INVENTION

Embodiments of the present invention successfully address at least some of the shortcomings of the prior art by providing a method, a device and compositions for providing exceptionally scratch-resistant print using liquid electrophotography.

According to the teachings of the present invention there is provided a UV-curable liquid toner composition for electrophotographic printing, comprising: a) a hydrocarbon-based liquid carrier; b) liquid electrophotography toner particles dispersed in the carrier; and c) in the carrier, a UV-curable component (in embodiments, dissolved in the carrier) comprising a higher acrylate portion including at least one acrylate higher than a diacrylate, e.g., triacrylates, tetraacrylates, pentacrylates, hexacrylates and even higher order acrylates.

In embodiments of the present invention, the UV-curable component constitutes a minor part of the toner composition, e.g., not more than about 15%, not more than about 8%, not more than about 4%, and even not more than about 3% by weight of the toner composition.

In embodiments of the present invention, the higher acrylate portion substantially consists of at least one acrylate higher than a triacrylate. Suitable higher acrylates include but are not limited to pentaerythritol tetraacrylate, di-trimethylolpropane tetraacrylate, dipentaerythritol pentaacrylate and ethoxylated pentaerythritol tetraacrylate.

In embodiments of the present invention, the higher acrylate portion comprises, substantially comprises or even essentially consists of at least one triacrylate. Suitable triacrylates include but are not limited to triacrylates such as ethoxylatedtrimethylolpropane triacrylate pentaerythritol triacrylate, 1,3-propanediol, 2-ethyl-2-(hydroxymethyl)triacrylate, propoxylated glyceryl triacrylate, propoxylatedtrimethylolpropane triacrylate, trimethylolpropane triacrylate (TMPTA) and tris(2-hydroxyethyl)isocyanurate triacrylate. A preferred triacrylate is trimethylolpropane triacrylate (TMPTA).

In embodiments of the present invention, the higher acrylate portion constitutes at least about 1%, at least about 5% and even at least about 20% by moles of acrylates comprising the UV-curable component.

In embodiments of the present invention, the higher acrylate portion constitutes up to about 95%, up to about 50% and even up to about 35% by moles of acrylates comprising the UV-curable component.

In embodiments of the present invention, the higher acrylate portion constitutes essentially the entire UV-curable component or even constitutes about 100% of acrylates comprising the UV-curable component.

In embodiments of the present invention, the UV-curable component further comprises a lower acrylate portion including at least one diacrylate or even at least two diacrylates in addition to the higher acrylate portion. Suitable diacrylates include but are not limited to diacrylates such as butylene glycol diacrylates, 1,3-butylene glycol diacrylate, butanediol diacrylates, 1,4-butanediol diacrylate, pentanediol diacrylates, 1,5-pentanediol diacrylate (HDDA), pentanediol diacrylates, 1,6-hexanediol diacrylate (HDDA), ethoxylated bisphenol A diacrylate, propoxylated neopentyl glycol diacrylate, propylene glycol diacrylate, dipropylene glycol diacrylate (DPGDA), tripropylene glycol diacrylate, ethylene glycol diacrylate, diethylene glycol diacrylate, triethylene glycol diacrylate, tetraethylene glycol diacrylate and polyethylene glycol diacrylate. In embodiments of the present invention, the lower acrylate portion comprises, substantially comprises and even essentially consists of 1,6-hexanediol diacrylate (HDDA) or dipropylene glycol diacrylate (DPGDA).

In embodiments of the present invention, the lower acrylate portion comprises, substantially comprises and even essentially consists of a mixture of 1,6-hexanediol diacrylate (HDDA) and dipropylene glycol diacrylate (DPGDA). In embodiments of the present invention including a mixture of HDDA and DPGDA, the weight ratio of the HDDA to the DPGDA in a toner composition is preferably between about 5:95 and about 95:5, between about 10:90 and about 90:10, between about 30:70 and about 70:30 and even between about 45:55 and about 55:45.

In embodiments of the present invention, the higher acrylate portion comprises a triacrylate and the lower acrylate portion includes at least one diacrylate or even at least two diacrylates. In embodiments of the present invention, the higher acrylate portion comprises trimethylolpropane triacrylate (TMPTA) and the lower acrylate portion comprises a mixture of hexanediol diacrylate (HDDA) and dipropylene glycol diacrylate (DPGDA). In embodiments of the present invention including TMPTA and a lower acrylate portion, the molar ratio of the TMPTA to the lower acrylate portion is preferably between about 1:99 and about 90:10, between about 15:85 and about 50:50, between about 20:80 and even between about 35:65.

In embodiments of the present invention, the UV-curable component further comprises a photosensitive portion including a photoinitiator. In embodiments of the present invention a photoinitiator comprises or even essentially consists of isopropylthioxanthone (ITX). In embodiments of the present invention, the photosensitive portion further includes a coinitiator. In embodiments of the present invention a photoinitiator comprises or even essentially consists of ethyl-4-(dimethylamino)benzoate) (EPD). In embodiments of the present invention, the photosensitive portion comprises no more than about 20% and even no more than about 15% by weight of the UV-curable component.

In embodiments of the present invention, the UV-curable component further comprises at least one stabilizer. In embodiments of the present invention the stabilizer comprises or even essentially consists of tris-(N-nitroso-N-phenylhydroxylamine) aluminium (N-PAL). In embodiments of the present invention, the stabilizer comprises no more than about 0.5% of the UV-curable component.

Generally, a carrier of an embodiment of a toner composition of the present invention is a prior art electrophotography toner carrier known to one skilled in the art. Thus, in embodiments of the present invention the hydrocarbon-based carrier comprises at least one aliphatic hydrocarbon, such as paraffins. Preferred carriers comprise, substantially comprise or even essentially consist of isoparaffins such as or equivalent the Isopar® high-purity isoparaffinic solvents with narrow boiling ranges marketed by Exxon Mobil Corporation (Fairfax, Va., USA). Such carriers have desirable properties such as low odor, lack of color, selective solvency, good oxidation stability, low electrical conductivity, low skin irritation, low surface tension, superior spreadability, narrow boiling point range, non-corrosive to metals, low freeze point, high electrical resistivity, high interfacial tension, low latent heat of vaporization and low photochemical reactivity.

The toner composition of the present embodiments may be made in the usual way, by appropriately combining the various components. The teachings of the present invention also allow for the modification of a prior art electrophotographic toner to provide a toner composition of the present embodiments. Thus, according to the teachings of the present invention there is provided a method of producing a composition useful as a toner in an electrophotographic printing process, comprising: a) providing an electrophotographic toner; and b) adding to the electrophotographic toner an amount of a UV-curable component, as described hereinabove, to provide a toner composition of embodiments of the present invention, as described above.

As discussed hereinabove, in embodiments of the present invention, the amount of UV-curable component added constitutes less than about 15% by weight of the toner composition. Suitable higher acrylates are as discussed hereinabove.

As discussed hereinabove, in embodiments of the present invention, the UV-curable component added further comprises a lower acrylate portion including at least one diacrylate and even at least two diacrylates in addition to the higher acrylate portion. Suitable diacrylates are as discussed hereinabove.

According to embodiments of the teachings of the present invention there is also provided a specific composition useful for providing scratch resistance to an electrophotographic toner comprising a) trimethylolpropane triacrylate (TMPTA) and b) a diacrylate portion including a diacrylate selected from the group consisting of 1,6-hexanediol diacrylate (HDDA), dipropylene glycol diacrylate (DPGDA) and mixtures thereof. In embodiments of the present invention, the composition comprises trimethylolpropane triacrylate (TMPTA), 1,6-hexanediol diacrylate (HDDA) and dipropylene glycol diacrylate (DPGDA).

In embodiments of the present invention, the trimethylolpropane triacrylate (TMPTA) constitutes no more than about 67%, no more than about 50% and even no more than about 35% by weight of the composition.

In embodiments of the present invention, the 1,6-hexanediol diacrylate (HDDA) constitutes no more than about 67%, no more than about 50% and even no more than about 35% by weight of the composition.

In embodiments of the present invention, the dipropylene glycol diacrylate (DPGDA) constitutes no more than about 67%, no more than about 50% and even no more than about 35% by weight of the composition.

In embodiments of the present invention, the composition further comprises a photosensitive portion including a photoinitiator. In embodiments of the present invention a photoinitiator comprises or even essentially consists of isopropylthioxanthone (ITX). In embodiments of the present invention, the photosensitive portion further includes a coinitiator. In embodiments of the present invention a photoinitiator comprises or even essentially consists of ethyl-4-(dimethylamino)benzoate) (EPD). In embodiments of the present invention, the photosensitive portion comprises no more than about 20% and even no more than about 15% by weight of the composition.

In embodiments of the present invention, the composition further comprises at least one stabilizer. In embodiments of the present invention the stabilizer comprises or even essentially consists of tris-(N-nitroso-N-phenylhydroxylamine) aluminium (N-PAL). In embodiments of the present invention, the stabilizer comprises no more than about 0.5% of the composition.

According to embodiments of the teachings of the present invention there is also provided method producing a composition useful as a toner in an electrophotographic printing process, comprising: a) providing an electrophotographic toner; and b) adding to the electrophotographic toner the components of a composition in accordance with embodiments of the present invention described hereinabove. In embodiments of the present invention, the components are first mixed together to make a composition in accordance with the present invention and then added to the electrophotographic toner.

According to embodiments of the teachings of the present invention there is also provided an electrophotographic printing device comprising a) an electrophotographic printing assembly configured to transfer liquid toner to a substrate moving in a direction and b) a UV irradiation assembly configured to receive the substrate directly from the electrophotographic printing assembly and to irradiate a surface of the substrate with light from a light source when the substrate is moving. In embodiments of the present invention, the light source includes a medium pressure mercury vapor lamp. In embodiments of the present invention, the lamp has a power of less than about 500 watt $inch^{-1}$. In embodiments of the present invention the UV irradiation assembly comprises a shaping component to illuminate a substrate in an area, the area having a dimension of no greater than about 2 cm, no greater than about 1 cm, no greater than about 5 mm and even no greater than about 2.5 mm in the direction. In embodiments of the present invention, the shaping component is a focusing component. In embodiments of the present invention, the device is configured to move the substrate at a rate of at least about 20 cm $sec^{-1}$, at least about 50 cm $sec^{-1}$, at least about 100 cm $sec^{-1}$ and even at least about 120 cm $sec^{-1}$.

According to embodiments of the teachings of the present invention there is provided a method of forming an image on a substrate, comprising: a) applying a UV-curable liquid toner composition (e.g., an embodiment of a toner composition of the present invention as described above) in a shape of an image to the substrate using an electrophotographic printer and b) illuminating the applied liquid toner with light from a light source for a period of time of no greater than about 20 msec, no greater than about 10 msec, no greater than about 5 msec and even no greater than about 2 msec. In embodiments of the present invention, the illuminating is substantially simultaneously for the image in entirety. In embodiments of the present invention illuminating is of strips of the image at any one time. In embodiments of the present invention, the UV-curable toner composition comprises a UV-curable component comprising a higher acrylate portion including at least one higher acrylate, e.g., a triacrylate. In embodiments of the present invention, the light source includes a medium pressure mercury vapor lamp. In embodiments of the present invention, such a lamp has a power of less than about 500 watt $inch^{-1}$. The method of the present invention may be implemented using a toner composition of the present invention and using a device of the present invention.

BRIEF DESCRIPTION OF THE DRAWINGS

The invention is herein described, by way of example only, with reference to the accompanying drawings. With specific reference now to the drawings in detail, it is stressed that the particulars shown are by way of example and for purposes of illustrative discussion of the embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings.

DESCRIPTION OF THE EMBODIMENTS

Figure 1:
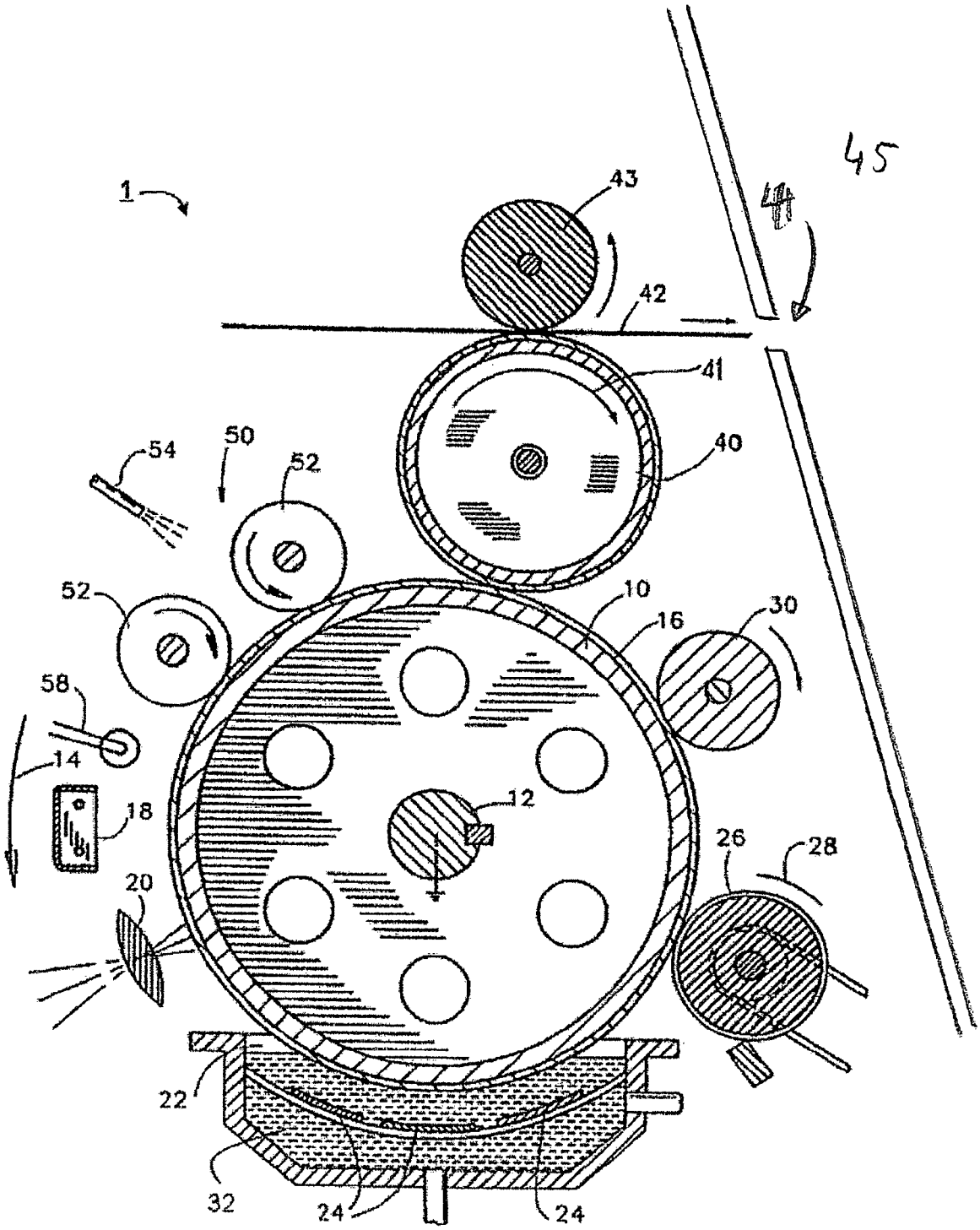
FIG. 1 schematically depicts, in cross section, an electrophotographic printing assembly of an electrophotographic printing device according to an embodiment of the present invention.

The teachings of the present invention relate to compositions, methods and devices useful in digital printing, particularly electrophotographic printing.

The teachings of the present invention provide a UV-curable liquid toner composition for electrophotographic printing, comprising a UV-curable component comprising a higher acrylate portion including at least one higher acrylate, that is a triacrylate or higher.

The teachings of the present invention also provide a method of producing a composition useful as a toner in an electrophotographic printing process, comprising adding a UV-curable component comprising a higher acrylate portion including at least one higher acrylate to an electrophotographic toner.

The teachings of the present invention also provide a specific composition useful for providing scratch resistance to an electrophotographic toner comprising trimethylolpropane triacrylate (TMPTA) and 1,6-hexanediol diacrylate (HDDA), dipropylene glycol diacrylate (DPGDA) and/or mixtures thereof.

The teachings of the present invention also provide a method of producing a composition useful as a toner in an electrophotographic printing process by adding the composition to an electrophotographic toner.

The teachings of the present invention also provide an electrophotographic printing device comprising a) an electrophotographic printing assembly configured to transfer liquid toner to a substrate moving in a direction; and b) a UV irradiation assembly configured to receive a substrate directly from the electrophotographic printing assembly and to irradiate a surface of the substrate with light from a light source when the substrate is moving.

The teachings of the present invention also provide a method of forming an image on a substrate, comprising: a) applying a UV-curable liquid toner composition in a shape of an image to the substrate using an electrophotographic printer; and b) illuminating the applied liquid toner with light from a light source for a period of time of no greater than about 20 msec.

The principles and uses of the teachings of the present invention may be better understood with reference to the accompanying description, figures and example. In the figures, like reference numerals refer to like parts throughout.

Before explaining at least one embodiment of the invention in detail, it is to be understood that the invention is not limited in its application to the details set forth herein. The invention can be implemented with other embodiments and can be practiced or carried out in various ways. It is also understood that the phraseology and terminology employed herein is for descriptive purpose and should not be regarded as limiting.

Generally, the nomenclature used herein and the laboratory procedures utilized in the present invention include techniques from the fields of chemistry, engineering and physics. Such techniques are thoroughly explained in the literature.

Unless otherwise defined, all technical and scientific terms used herein have the same meaning as commonly understood by one of ordinary skill in the art to which the invention belongs. In addition, the descriptions, materials, methods, and examples are illustrative only and not intended to be limiting. Methods and materials similar or equivalent to those described herein can be used in the practice or testing of the present invention.

As used herein, the terms "comprising" and "including" or grammatical variants thereof are to be taken as specifying the stated features, integers, steps or components but do not preclude the addition of one or more additional features, integers, steps, components or groups thereof. This term encompasses the terms "consisting of" and "consisting essentially of".

The phrase "consisting essentially of" or grammatical variants thereof when used herein are to be taken as specifying the stated features, integers, steps or components but do not preclude the addition of one or more additional features, integers, steps, components or groups thereof but only if the additional features, integers, steps, components or groups thereof do not materially alter the basic and novel characteristics of the claimed composition, device or method.

The term "method" refers to manners, means, techniques and procedures for accomplishing a given task including, but not limited to, those manners, means, techniques and procedures either known to, or readily developed from known manners, means, techniques and procedures by practitioners of the chemical, pharmacological, biological, biochemical and medical arts. Implementation of the methods of the present invention involves performing or completing selected tasks or steps manually, automatically, or a combination thereof.

Electrophotographic printing generally provides a laminate print that is not substantially absorbed into the substrate on which applied. The laminate is therefore prone to mechanical damage such as feeling, peeling, scratching for example during mechanical processing of the printed matter during sorting and postage.

In printing technologies other than electrophotographic printing, such as inkjet printing, it is known to provide scratch resistance to resulting print by incorporating materials into a respective toner or ink that polymerizes on the substrate subsequent to printing. Preferred is the use of UV curable ink since polymerization occurs only under special irradiation conditions initiated only subsequent to printing. That said, since each printing technology is based on entirely unrelated physical principles, is mechanically different and requires ink or toner compositions having entirely different physical and chemical properties, there is little to be related from the study of one printing technology to a different printing technology except the general concept that the crosslinking density of the polymer effects print properties related to scratch resistance such as adhesion, flaking, scratch resistance and peeling.

Embodiments of the present invention provide a liquid toner composition for use in electrophotographic printing devices, including prior art electrophotographic printing devices.

A toner composition of embodiments of the present invention comprises a hydrocarbon-based liquid carrier, liquid electrophotography toner particles dispersed in the carrier and a UV-curable component (preferably dissolved in the carrier) comprising a higher acrylate portion including at least one acrylate higher than a diacrylate. As described in greater detail below, subsequent to printing, an embodiment of the toner of the present is cured with exposure to UV light. The UV-curable component polymerizes producing a polymerized structure that provides the print with greater scratch resistance than with prior art electrophotographic toners.

Generally, the UV-curable component constitutes not more than about 15%, not more than about 8% and even not more than about 4% by weight of the toner composition. Generally the UV-curable component constitutes between about 2% and about 4% by weight of the toner composition.

Typically, the higher acrylate portion includes one or more material such as a triacrylate, tetraacrylate, pentacrylate and/or hexacrylate.

In embodiments, the higher acrylate portion substantially consists of at least one acrylate higher than a triacrylate. Suitable such acrylates include but are not limited to pentaerythritol tetraacrylate, di-trimethylolpropane tetraacrylate, dipentaerythritol pentaacrylate and ethoxylated pentaerythritol tetraacrylate.

In embodiments of the present invention the higher acrylate portion comprises, substantially comprises or essentially consists of on or more triacrylates. Suitable triacrylates include but are not limited to ethoxylatedtrimethylolpropane triacrylate pentaerythritol triacrylate, 1,3-propanediol,2-ethyl-2-(hydroxymethyl)triacrylate, propoxylated glyceryl triacrylate, propoxylatedtrimethylolpropane triacrylate, trimethylolpropane triacrylate (TMPTA) and tris(2-hydroxyethyl)isocyanurate triacrylate. In embodiments of the present invention, TMPTA is preferred.

Generally, the higher acrylate portion makes up at least about 1% and even at least about 5% by moles of acrylates of the UV-curable component. In embodiments of the present invention the higher acrylate portion constitutes essentially all of the acrylates of the UV curable component, and even about 100% of the acrylates of the UV-curable component. Generally, the higher acrylate portion makes up no more than about 95%, no more than about 50% and even no more than about 35% by moles of acrylates of the UV-curable component.

In embodiments of the present invention, the UV-curable component further comprises a lower acrylate portion including at least one diacrylate or even at least two diacrylates. Suitable diacrylates include but are limited to butylene glycol diacrylates, 1,3-butylene glycol diacrylate, butanediol diacrylates, 1,4-butanediol diacrylate, pentanediol diacrylates, 1,5-pentanediol diacrylate (HDDA), pentanediol diacrylates, 1,6-hexanediol diacrylate (HDDA), ethoxylated bisphenol A diacrylate, propoxylated neopentyl glycol diacrylate, propylene glycol diacrylate, dipropylene glycol diacrylate (DPGDA), tripropylene glycol diacrylate, ethylene glycol diacrylate, diethylene glycol diacrylate, triethylene glycol diacrylate, tetraethylene glycol diacrylate and polyethylene glycol diacrylate. In embodiments of the present invention, the lower acrylate portion comprises either or both HDDA and DPGDA.

In embodiments of the present invention the lower acrylate portion comprises, substantially comprises or essentially consists of a mixture of HDDA and DPGDA. In embodiments of the present invention including a mixture of HDDA and DPGDA, the weight ratio of HDDA to DPGDA is generally between about 5:95 and about 95:5, 10:90 and about 90:10, between about 30:70 and about 70:30 and even between about 45:55 and about 55:45.

In embodiments of the present invention, the higher acrylate portion comprises a triacrylate and the lower acrylate portion includes at least one diacrylate or even at least two diacrylates. In embodiments of the present invention, the higher acrylate portion comprises TMPTA and the lower acrylate portion comprises a mixture of HDDA and DPGDA. In embodiments of the present invention where the higher acrylate portion comprises TMPTA and the lower acrylate portion includes at least one diacrylate or even at least two diacrylates, the molar ratio of TMPTA to the lower acrylate portion is between about 1:99 and about 90:10, between about 15:85 and about 50:50 and even between about 20:80 and about 35:65.

Generally, a UV-curable component of embodiments of the present invention includes a photosensitive portion including one or more photoinitiators to initiate crosslinking of the coatings directly on the substrate, generally by production of free radicals. Radicals are typically produced by hydrogen abstraction upon exposure to UV light. The best photoinitiator for any given application might be selected based on many factors. These factors include desired film thickness, utilized light source, production line speed, and the presence or absence of other UV absorbing species such as pigments or dyes. Photoinitiators suitable for implementing embodiments of the teachings of the present invention include but are not limited to benzophenone, 1-hydroxycyclohexyl phenyl ketone, 2-benzyl-2-dimethylamino-(4-morpholinaphenyl) butan-1-one, benzyl dimethylketal, isopropylthioxanthone (ITX), ethyl-4-(dimethylamino)benzoate, bis(2,6-dimethylbenzoyl)-2,4,4-trimethylpentylphosphine oxide and any mixture thereof. One suitable photoinitiator is isopropylthioxanthone. In embodiments of the present invention, a photosensitive portion of the UV-curable component of a toner of embodiments of the present invention includes a coinitiator (e.g., ethyl-4-(dimethylamino)benzoate) (EPD)). For example, in embodiments of the present invention a photosensitive portion comprises isopropylthioxanthone in combination with ethyl-4-(dimethylamino)benzoate. In embodiments of the present invention including a photosensitive portion, the photosensitive portion generally comprises no more than about 20% or even no more than about 15% by weight of the UV-curable component.

In embodiments of the present invention, the UV-curable component of a toner of embodiments of the present invention also includes at least one stabilizer (e.g., tris-(N-nitroso-N-phenylhydroxylamine) aluminium (N-PAL) to prevent premature polymerization. In embodiments of the present invention including a stabilizer, the stabilizer generally comprises no more than about 1% or even no more than about 0.5% by weight of the UV-curable component.

The hydrocarbon-based carrier of a toner of embodiments of the present invention is substantially similar to carriers used in prior art liquid electrophotography toners. Generally such toners include at least one aliphatic hydrocarbon, such as paraffins and isoparaffins. Preferred carriers comprise, substantially comprise or even essentially consist of isoparaffins such as or equivalent the Isopar® high-purity isoparaffinic solvents with narrow boiling ranges marketed by Exxon Mobil Corporation (Fairfax, Va., USA). Also suitable as carriers or components of carriers for implementing embodiments of the present invention are alkanes having from about 6 to about 14 carbon atoms such as solvents sold under the Norpar® (Norpar® 12, 13 and 15) tradename available from Exxon Mobil Corporation (Fairfax, Va., USA). Other hydrocarbons for use as carriers or carrier components are sold under the Amsco® (Amsco® 460 and OMS) tradename available from American Mineral Spirits Company (New York, N.Y., USA), under the Soltrol® tradename available from Chevron Phillips Chemical Company LLC (The Woodlands, Tex., USA) and under the Shellsol® tradename available from Shell Chemicals Limited (London, UK). Such carriers and carrier components have desirable properties such as low odor, lack of color, selective solvency, good oxidation stability, low electrical conductivity, low skin irritation, low surface tension, superior spreadability, narrow boiling point range, non-corrosive to metals, low freeze point, high electrical resistivity, high interfacial tension, low latent heat of vaporization and low photochemical reactivity.

The toner particles dispersed in the carrier are any colored particle compatible with the liquid carrier and useful for electrophotographic printing. For example, the toner particles can consist solely of pigment particles, or may comprise a resin and a pigment; a resin and a dye; or a resin, a pigment, and a dye. The resins, pigments and dyes can be any of those commonly used as described, for example, in U.S. Pat. Nos. 4,794,651; 4,842,974; 5,047,306; 5,407,307; 5,192,638; 5,208,130; 5,225,306; 5,264,312; 5,266,435; 5,286,593; 5,300,390; 5,346,796; 5,407,771; 5,554,476; 5,655,194; 5,792,584; 5,5923,929; 5,574,547 and 5,558,970.

The teachings of embodiments of the present invention also provide a composition useful for providing scratch resistance to an electrophotographic toner as described above. A composition of embodiments of the present invention is substantially the components of embodiments of a UV-curable component of a toner composition of the present invention, as described above, added to a toner composition in accordance with the teachings of the present invention to provide added scratch resistance as described herein. Such components include a higher acrylate portion including at least one acrylate higher than a diacrylate and optional components such as a lower acrylate portion including one or more diacrylates, a photosensitive portion including a photoinitiator and optionally a coinitiator, and a stabilizer.

A specific composition of the present invent that has been found to provide exceptional scratch resistance to an electrophotographic toner comprises trimethylolpropane triacrylate (TMPTA) and a diacrylate portion including a diacrylate selected from the group consisting of 1,6-hexanediol diacrylate (HDDA), dipropylene glycol diacrylate (DPGDA) and mixtures thereof, and preferably trimethylolpropane triacrylate (TMPTA), 1,6-hexanediol diacrylate (HDDA) and dipropylene glycol diacrylate (DPGDA).

In embodiments of the specific composition, the TMPTA generally constitutes no more than about 67%, no more than about 50% and even no more than about 35% by weight of the composition. In embodiments of the specific composition, the HDDA generally constitutes no more than about 67%, no more than about 50% and even no more than about 35% by weight of the composition. In embodiments of the specific composition, the DPGDA generally constitutes no more than about 67%, no more than about 50% and even no more than about 35% by weight of the composition. Embodiments of the specific composition of the present invention comprise equal amounts (by weight) of TMPTA, HDDA and DPGDA.

Embodiments of the specific composition of the present invention include a photosensitive portion including a photoinitiator, such as isopropylthioxanthone (ITX) and a coinitiator such as ethyl-4-(dimethylamino)benzoate) (EPD). In embodiments of the specific composition, the photosensitive portion generally constitutes no more than about 20% or even no more than about 15% by weight of the composition.

Embodiments of the specific composition of the present invention include a stabilizer, such as tris-(N-nitroso-N-phenylhydroxylamine) aluminium (N-PAL). In embodiments of the specific composition, the stabilizer generally constitutes no more than about 1% or even no more than about 0.5% by weight of the composition.

Preparation of embodiments of a composition of the present invention or of embodiments of a toner of the present invention is generally simple. In embodiments of the present invention, the various components of a composition or a toner composition of the present invention are combined serially or simultaneously to provide the respective composition or toner composition. Methods of combining various components and any specific order in which components are combined can be easily determined by one of average skilled in the arts upon perusal of the description.

As noted above, an advantage of the teachings of embodiments of the present invention is that one method of making an embodiment of a toner of the present invention is by adding an embodiment of a composition of the present invention to a prior art liquid electrophotography toner, that is to say embodiments the teachings of the present invention allow "upgrading" of an existing toner to an embodiment of a toner of the present invention. In embodiments of the present invention, the components of a composition of the present invention are added, singly or in groups, serially or simultaneously, to an existing prior art toner and then mixed together to provide an embodiment of a toner composition of the present invention. In embodiments of the present invention, the components of a composition of the present invention are first combined to actually provide an embodiment of a composition of the present invention and thereafter added to an exiting toner to provide a toner composition of the present invention.

A particularly suitable liquid toner with which embodiments of the teachings of the present invention are advantageously implemented is known by the trade name ElectroInk® (Hewlett Packard Company, Maastricht, The Netherlands). ElectroInk® is characterized in that it comprises electrically charged toner particles of very small size (generally about 1-2 microns) dispersed in a carrier liquid, with the toner particles comprising a polymeric core with fibrous extensions extending from the core. When the toner particles are dispersed in the carrier liquid in a low concentration, the particles remain separate. When the toner develops an electrophotographic image the concentration of toner particles increases and the fibrous extensions interlock. Such toners are described, inter alia, in U.S. Pat. Nos. 4,794,651; 4,842,974; 5,047,306; 5,407,307; 5,192,638; 5,208,130; 5,225,306; 5,264,312; 5,266,435; 5,286,593; 5,300,390; 5,346,796; 5,407,771; 5,554;476; 5,655,194; 5,792,584 and 5,5923,929, which are incorporated by reference as if fully set forth herein.

In embodiments of the present invention, there is difficulty in providing a homogenous toner of an embodiment of the present invention due to the fact that the carrier is generally non-polar while the UV-curable component may include salts and polar compounds. Thus, in embodiments of the present invention, the components of the UV-curable component are added to a dispersion of the toner particles in the hydrocarbon-based liquid carrier. Preferably, the components of the UV-curable component are first combined and thereafter added to the dispersion of toner particles in the carrier. Without being bound to any particular theory, it is assumed that the acrylate components of the UV-polymerizable component act as surfactants to facilitate mixing and possibly even solvation of polar compounds in the carrier.

Embodiments of the present invention further provide an electrophotographic printing device for forming an image on a substrate, the device comprising an electrophotographic printing assembly, such as a prior art electrophotographic printing assembly, and a UV-irradiation assembly configured to receive the substrate directly from the electrophotographic printing assembly.

Reference is now made to FIG. 1, which is a schematic illustration of a monochrome electrophotographic printing assembly 1 of an electrophotographic printing device according to an embodiment of the present invention. Assembly 1 comprises a drum 10 arranged for rotation about, an axle 12 in a direction generally indicated by arrow 14. Drum 10 is formed with an imaging surface 16, e.g., a photoconductive surface.

A charging unit 18, which can be a corotron, a scorotron, a roller charger or any other suitable charging unit known in the art, uniformly charges an area of surface 16, for example, with positive charge.

Rotation of the drum 10 brings the area of surface 16 to an image receiving relationship with an exposing unit 20, which focuses a desired image onto the area of the surface 16. Unit 20 selectively discharges the area of surface 16 in the regions exposed to light, thereby forming an electrophotographic latent image. Usually, the desired image is discharged by the light while the background areas remain electrophotographically charged. Thus, the latent image normally includes image regions at a first electrical potential and background regions at another electrical potential. Unit 20 may be a modulated laser beam-scanning device, an optical focusing device or any other imaging device known in the art.

Continued rotation of the drum 10 brings the area of surface 16, now bearing the electrophotographic latent image, into a developing unit 22, which typically comprises electrodes 24 operative to apply the liquid toner 32 of an embodiment of the present invention on the area of surface 16, so as to develop the electrophotographic latent image.

Following application of liquid toner 32 thereto, the area of surface 16 passes a roller 26, which is typically charged to the same polarity as the toner particles and rotates in a direction indicated by an arrow 28. Roller 26 serves to reduce the thickness of liquid toner 32. Once the area of surface 16 passes roller 26, the regions corresponding to the latent image are covered by liquid toner 32.

The separation between roller 26 and surface 16 is typically about 50 microns. The electric potential of roller 26 is typically intermediate the aforementioned first and second electric potential of the latent image regions and of the background regions on the area of surface 16. Representative examples of voltage configuration include, without limitation, roller 26: from about +300 to about +500 volts, background area: about +50 volts and latent image areas: up to about +1000 volts.

Assembly 1 further comprise a squeegee 30, positioned downstream of drum 10, typically maintained in contacting or pressured relationship with surface 16. Squeegee 30 can be held at negative potential, e.g., from about 1000 to about 2000 volts, such that corona discharge takes place and electrical current flows from squeegee 30. Squeegee 30 repels the negatively charged toner particles, concentrating the particles on the image regions of the area of surface 16, sharpening the toner image thereon.

The toner image is transferred, typically via electrophotographic attraction, to an intermediate transfer member 40, rotating in direction 41, which is opposite to direction 14 of drum 10. Subsequently, the image is transferred a second time, typically under heat and pressure, from transfer member 40 to a substrate 42, which is supported by a roller 43.

Following the transfer of the liquid image to transfer member 40, surface 16 is engaged by a cleaning roller assembly 50, typically comprising a nozzle 54 to apply cleaning material to surface 16 and two oppositely rotating rollers 52 to scrub surface 16. Assembly 50 cleans surface 16 clean, for example from toner residue. Residual charge left on surface 16 is removed, e.g., by flooding surface 16 with light from a lamp 58.

Following transfer of the image to substrate 42, substrate 42 is ejected through substrate exit slot 44 from electrophotographic printing assembly 1 into UV irradiation assembly 45.

Figure 2:
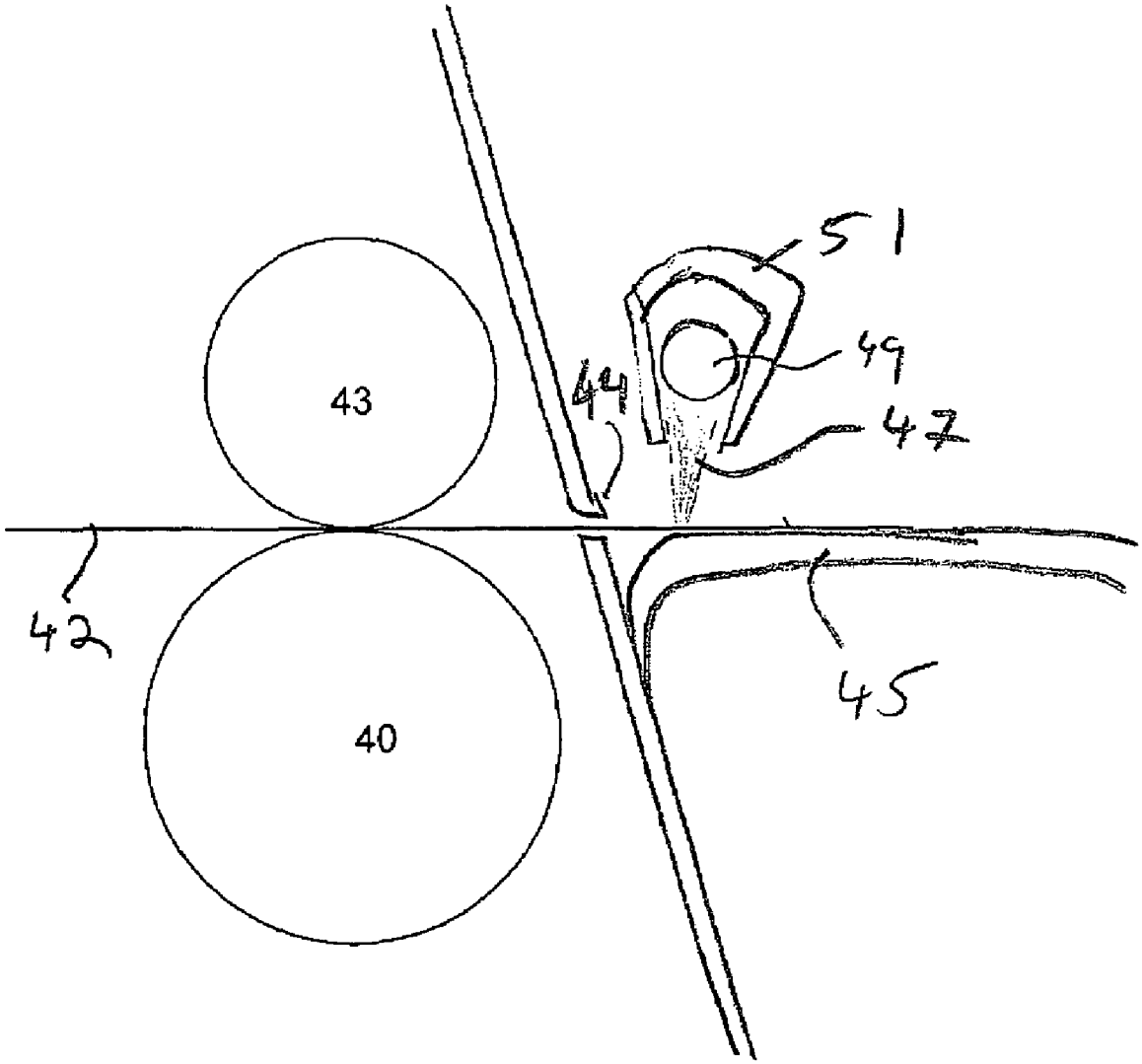
FIG. 2 schematically depicts, in cross section, a UV irradiation assembly of an electrophotographic printing device according to a further embodiment of the present invention.

In irradiation assembly 45, see FIG. 2, substrate 42 lays on support surface 45 and is illuminated by beam 47 produced by the focusing of light emitted by light source 49 (a medium pressure mercury vapor lamp) by shaping element 51 (such as a focusing element, in FIG. 2, a parabolic cross section mirror). Beam 47 illuminates surface 45 in a substantially rectangular area that extends across the breadth of support surface 45 but is relatively narrow. Thus, as substrate 42 travels across surface 45, each part of the surface of substrate 42 is illuminated by beam 47 in which time the UV-curable liquid toner composition polymerizes.

In order to minimize the size of an electrophotographic printing device of an embodiment of the present invention, it is preferred that a shaping element 51 be configured to project light from light source 49, preferably by focusing, to as narrow as possible an image on surface 45. In embodiments of the present invention, shaping element 51 is configured to focus light from light source 49 to a line no more than 2 cm, no more than 1 cm, no more than 5 mm and even no more than 2.5 mm in the direction of travel of substrate 42.

It is important that irradiation assembly 45 be configured to illuminate a given substrate to such an extent so as not to limit the printing rate of an embodiment of a electrophotographic printing device of the present invention, that is to say the intensity and flux of light 47, and the time which a given portion of substrate 42 is exposed to light 47 is such that sufficient curing of the print is achieved. In embodiments, an electrophotographic printing device is configured to have a printing rate (and thus a rate of substrate entry into and passage through a respective irradiation assembly) of at least about 20 cm $sec^{-1}$, at least about 50 cm $sec^{-1}$, at least about 100 cm $sec^{-1}$, and even at least about 120 cm $sec^{-1}$. In embodiments, an irradiation assembly of a device of the present invention is configured to illuminate a given portion of a substrate for no greater than about 20 msec, no greater than about 10 msec, no greater than about 5 msec and even no greater than about 2 msec.

Embodiments of the device and method of the present invention have been described with reference to monochromatic printing. One of average skilled in the art is able to apply the teachings of the present invention to multichromatic or polychromatic electrophotographic printing upon perusal of the description herein.

Additional objects, advantages and novel features of the present invention will become apparent to one ordinarily skilled in the art upon examination of the following examples, which are not intended to be limiting. Additionally, each of the various embodiments and aspects of the present invention as delineated hereinabove and as claimed in the claims section below finds experimental support in the following examples.

EXAMPLES

Reference is now made to the following example, which, together with the above descriptions, illustrates embodiments of the invention in a non-limiting fashion.

Materials and Experimental Methods

Chemicals:

Tris(N-nitroso-N-phenylhydroxylamine) Aluminium salt (N-PAL) was purchased from Albemarle Corporation (Richmond, Va., USA).

Additol® ITX (isopropylthioxanthone), Additol® EPD (ethyl-4-(dimethylamino)benzoate), DPGDA (Dipropylene glycol di-acrylate), Trimethylolpropane triacrylate (TMPTA) and hexanedioldiacrylate (HDDA) were purchased from UCB (Atlanta, Ga., USA).

ElectroInk® toners were available from Hewlett Packard Company, Maastricht, The Netherlands.

Isopar® L was purchased from Exxon Mobil Corporation, Fairfax, Va., USA. Isopar® L is characterized in having a Kauri-butanol value of 27, an aniline point of 85° C., a flash point of 64° C. (ASTM D56 TCC), distillation @ 189° C. (ASTM D86 IBP), distillation @ 207° C (ASTM D86, dry point), a specific gravity of 0.77 @ 15.6° C. (ASTM D1250), 99.9% saturates, less than 0.01% aromatics, a surface tension of 25.1 dynes $cm^{-1}$ @ 25° C. (ASTM D971) and an interfacial tension of 49.8 @ 25° C.

Preparation of a Composition of Embodiments of the Present Invention:

A composition of an embodiment of the present invention including the components listed in Table 1 was prepared.

TABLE 1

| | compound | % w/w | Molar Ratio |
|---|---|---|---|
| Triacrylate | Trimethylolpropane triacrylate (TMPTA) (MW 296) | 30 | 28 |

TABLE 1-continued

| | compound | % w/w | Molar Ratio |
|---|---|---|---|
| Diacrylate 1 | Dipropylene glycol diacrylate (DPGDA) (MW 242) | 29.85 | 35 |
| Diacrylate 2 | 1,6-Hexanediol diacrylate (HDDA) (MW 226) | 30 | 37 |
| Photoinitiator | Isopropylthioxanthone (ITX) | 5 | |
| Coinitiator | ethyl-4-(dimethylamino)benzoate) (EPD) | 5 | |
| Stabilizer | tris-(N-nitroso-N-phenyl hydroxylamine)aluminium (N-PAL) | 0.15 | |

The various components were mixed together in a flask using a magnetic stirrer until a clear homogenous embodiment of a composition of the present invention embodiments was produced.

UV-Curable Liquid Toner Compositions:

ElectroInk® Toner for use with electrophotographic printers is delivered as a paste with 10% solids that is manually or automatically diluted to a working dispersion with 2% solids for printing.

A working dispersion of the reference toner was prepared by diluting 1 part HP ElectroInk Mark 4.0 Cyan (Cat. Nr. Q4013A) with 4 parts Isopar® L.

A working dispersion of a UV-curable liquid toner composition of the present embodiments was prepared by diluting 1 part HP ElectroInk Mark 3.6 Cyan (Cat. Nr. MPS-3132-43) with 4 parts Isopar® L and then adding 2% by weight of the composition of the present embodiments thereto.

Printing and Curing

A specially designed irradiation enclosure was attached to the waste tray of a commercially available HP-5000 electrophotographic printer (Hewlett-Packard Company, Palo Alto, Calif., USA). The irradiation enclosure was provided with a flush flat surface that allowed a printed A3 sheet of substrate to travel across the surface unhindered. The irradiation enclosure was also provided with a Light Hammer® 6 medium pressure mercury vapor lamp (metal halide doped, D-type bulb) producing an Fe-spectrum purchased from Fusion UV Systems, Inc. (Gaithersburg, Md., USA) (maximum 467 Watt $inch^{-1}$) with a parabolic cross-section reflector positioned at a distance of 53 mm from the substrate surface to focus the entire spectrum of produced light to illuminate a 6 inch broad by 2 mm wide line on printed substrate exiting through the waste tray. During testing the sheets of substrate were transported at a rate of 1.2 m $sec^{-1}$. As a result, each sheet was illuminated in an area that was a 6 inch wide strip along the entire length, each point in the area illuminated for a period of 1.7 milliseconds.

The HP-5000® printer was charged with the reference toner and used to print on 300 g $m^{-2}$ matt white BVS-coated paper (Papierfabrik Scheufelen GmbH & Co. KG, Lenningen, Germany) under conventional printing conditions. The printed-paper was irradiated in the irradiation enclosure as described hereinabove. A first sample was of conventional 12 point text. A second sample was printing on the entire surface of the sheet of paper of four layers (400%) coverage.

The HP-5000® printer was charged with the embodiment of the toner of the present invention prepared as above and used to print on 300 g $m^{-2}$ matt white BVS-coated paper (Papierfabrik Scheufelen GmbH & Co. KG, Lenningen, Germany) under conventional printing conditions. The printed-paper was irradiated in the irradiation enclosure as described hereinabove. A first sample was of conventional 12 point text. A second sample was printing on the entire surface of the sheet of paper of four layers (400%) coverage.

Print Quality

Both the prior art and the embodiment of a toner composition of the present invention produced substantially identical printing results in the respective first sample with equal resolution and line smoothness Scratch Resistance Test The scratch resistance of the print of the two second samples as described above was tested in the usual way using a Taber® Shear/Scratch Tester Models 551 (Taber Industries, North Tonawanda, N.Y., USA) with a 50 gram load on a 4 $inch^2$ round area of the respective second samples.

The results of the scratch resistance tests are summarized in Table 2. It is seen that under equivalent conditions, an embodiment of a toner composition of the present invention embodiments is far more scratch resistant than a substantially equivalent prior art toner.

TABLE 2

Scratch resistance tests of inventive composition and reference products

| | Average weight loss in milligrams |
|---|---|
| Reference toner | 480 |
| Test toner | 140 |

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims. All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

What is claimed is:

1. A UV-curable liquid toner composition for electrophotographic printing, comprising:

a) a hydrocarbon-based liquid carrier;

b) liquid electrophotography toner particles dispersed in said carrier; and c) in said carrier, a UV-curable component comprising a higher acrylate portion including at least one non-polymeric higher acrylate.

2. The composition of claim 1, said UV-curable component constituting not more than about 15% by weight of the composition.

3. The composition of claim 1, said higher acrylate portion including at least one material selected from the group consisting of triacrylates, tetraacrylates, pentacrylates and hexacrylates.

4. The composition of claim 3, said higher acrylate portion comprising at least one triacrylate.

5. The composition of claim 4, said triacrylate being selected from the group consisting of ethoxylatedtrimethylolpropane triacrylate pentaerythritol triacrylate, 1,3-propanediol,2-ethyl-2-(hydroxymethyl) triacrylate, propoxylated glyceryl triacrylate, propoxylatedtrimethylolpropane triacrylate, trimethylolpropane triacrylate (TMPTA) and tris (2-hydroxyethyl) isocyanurate triacrylate.

6. The composition of claim 4, wherein said triacrylate is trimethylolpropane triacrylate (TMPTA).

7. The composition of claim 1, wherein said higher acrylate portion constitutes at least about 1% by moles of acrylates of said UV-curable component.

8. The composition of claim 1, wherein said higher acrylate portion constitutes up to about 95% by moles of acrylates of said UV-curable component.

9. The composition of claim 1, wherein said UV-curable component further comprises a lower acrylate portion including at least one diacrylate.

10. The composition of claim 9, said lower acrylate portion comprising at least two diacrylates.

11. The composition of claim 9, said diacrylate being selected from the group consisting of butylene glycol diacrylates, 1,3-butylene glycol diacrylate, butanediol diacrylates, 1,4-butanediol diacrylate, pentanediol diacrylates, 1,5-pentanediol diacrylate (HDDA), pentanediol diacrylates, 1,6-hexanediol diacrylate (HDDA), ethoxylated bisphenol A diacrylate, propoxylated neopentyl glycol diacrylate, propylene glycol diacrylate, dipropylene glycol diacrylate (DPGDA), tripropylene glycol diacrylate, ethylene glycol diacrylate, diethylene glycol diacrylate, triethylene glycol diacrylate, tetraethylene glycol diacrylate and polyethylene glycol diacrylate.

12. The composition of claim 9, said lower acrylate portion comprising 1,6-hexanediol diacrylate (HDDA).

13. The composition of claim 9, said lower acrylate portion comprising dipropylene glycol diacrylate (DPGDA).

14. The composition of claim 9, wherein said higher acrylate portion comprises a triacrylate and said lower acrylate portion includes at least one diacrylate.

15. The composition of claim 14, wherein said higher acrylate portion comprises a triacrylate and said lower acrylate portion includes at least two diacrylates.

16. A UV-curable liquid toner composition for electrophotographic printing, comprising:

a) a hydrocarbon-based liquid carrier;

b) liquid electrophotography toner particles dispersed in said carrier; and c) in said carrier, a UV-curable component comprising a higher acrylate portion including non-polymeric trimethylolpropane triacrylate (TMPTA) and a lower acrylate portion including at least one non-polymeric diacrylate selected from the group consisting of 1,6-hexanediol diacrylate (HDDA), dipropylene glycol diacrylate (DPGDA), and mixtures thereof.

17. The composition of claim 16 wherein the lower acrylate portion comprises HDDA and DPGDA.

18. A UV-curable liquid toner composition for electrophotographic printing, comprising:

a) a hydrocarbon-based liquid carrier;

b) liquid electrophotography toner particles dispersed in said carrier; and c) in said carrier, a UV-curable component comprising a higher acrylate portion including at least one higher acrylate and a lower acrylate portion including at least one non-polymeric diacrylate, the UV-curable component constituting not more than about 15% by weight of the composition, and the higher acrylate portion constituting from about 1% up to about 95% by moles of acrylates of the UV-curable component.

19. The composition of claim 18, said higher acrylate portion including at least one material selected from the group consisting of triacrylates, tetraacrylates, pentacrylates and hexacrylates.

20. The composition of claim 19, said higher acrylate portion comprising at least one triacrylate.

21. The composition of claim 20, said triacrylate being selected from the group consisting of ethoxylatedtrimethylolpropane triacrylate pentaerythritol triacrylate, 1,3-propanediol,2-ethyl-2-(hydroxymethyl) triacrylate, propoxylated glyceryl triacrylate, propoxylatedtrimethylolpropane triacrylate, trimethylolpropane triacrylate (TMPTA) and tris (2-hydroxyethyl) isocyanurate triacrylate.

22. The composition of claim 20, wherein said triacrylate is trimethylolpropane triacrylate (TMPTA).

23. The composition of claim 18, said lower acrylate portion comprising at least two diacrylates.

24. The composition of claim 18, said diacrylate being selected from the group consisting of butylene glycol diacrylates, 1,3-butylene glycol diacrylate, butanediol diacrylates, 1,4-butanediol diacrylate, pentanediol diacrylates, 1,5-pentanediol diacrylate (HDDA), pentanediol diacrylates, 1,6-hexanediol diacrylate (HDDA), ethoxylated bisphenol A diacrylate, propoxylated neopentyl glycol diacrylate, propylene glycol diacrylate, dipropylene glycol diacrylate (DPGDA), tripropylene glycol diacrylate, ethylene glycol diacrylate, diethylene glycol diacrylate, triethylene glycol diacrylate, tetraethylene glycol diacrylate and polyethylene glycol diacrylate.

25. The composition of claim 18, said lower acrylate portion comprising 1,6-hexanediol diacrylate (HDDA).

26. The composition of claim 18, said lower acrylate portion comprising dipropylene glycol diacrylate (DPGDA).

27. A UV-curable liquid toner composition for electrophotographic printing, comprising:

a) a hydrocarbon-based liquid carrier;

b) liquid electrophotography toner particles dispersed in said carrier; and c) in said carrier, a UV-curable component comprising a higher acrylate portion including non-polymeric trimethylolpropane triacrylate (TMPTA) and a lower acrylate portion including at least one non-polymeric diacrylate selected from the group consisting of 1,6-hexanediol diacrylate (HDDA), dipropylene glycol diacrylate (DPGDA), and mixtures thereof, the UV-curable component constituting not more than about 4% by weight of the composition, the higher acrylate portion constituting from about 5% up to about 35% by moles of acrylates the UV-curable component, and a molar ratio of TMPTA to the lower acrylate portion being between about 20:80 and about 35:65.

* * * * *